United States Patent [19]

Kurlytis et al.

[11] Patent Number: 4,693,468

[45] Date of Patent: Sep. 15, 1987

[54] EXERCISE MACHINE HAVING PEDALS WHICH EXTEND RADIALLY AGAINST RESISTIVE MEANS

[76] Inventors: Paul C. Kurlytis, 5485 Desert La., Silver Springs, Nev. 89429; Clayton A. Carpenter, 1175 Yates La., Reno, Nev. 89509

[21] Appl. No.: 765,559

[22] Filed: Aug. 13, 1985

Related U.S. Application Data

[63] Continuation-in-part of Ser. No. 708,233, Mar. 5, 1985, abandoned.

[51] Int. Cl.[4] ..... A63B 21/00; G05G 1/14

[52] U.S. Cl. ..... 272/73; 74/594.3

[58] Field of Search ..... 272/73, 70.1; 74/594.3, 74/594.7, 601

[56] References Cited

U.S. PATENT DOCUMENTS

| | | | |
|---|---|---|---|
| 538,242 | 4/1895 | Devers | 74/594.3 |
| 653,873 | 7/1900 | Malone | 74/594.3 |
| 2,783,997 | 3/1957 | Gaffney et al. | 272/70.1 |
| 3,216,722 | 11/1965 | Odom | 272/73 |
| 3,848,870 | 11/1974 | Craig | 272/73 |
| 4,257,588 | 3/1981 | Ketchman | 272/73 |

FOREIGN PATENT DOCUMENTS

| | | | |
|---|---|---|---|
| 730035 | 3/1966 | Canada | 272/73 |
| 113321 | 10/1899 | Fed. Rep. of Germany | 74/594.3 |
| 918488 | 9/1954 | Fed. Rep. of Germany | 74/594.3 |

*Primary Examiner*—Richard J. Apley
*Assistant Examiner*—S. R. Crow
*Attorney, Agent, or Firm*—Norman E. Reitz

[57] ABSTRACT

An exercise machine for exercising the forward and backward muscles in the upper and lower muscle groups. A first bidirectional exercise unit is attached to a frame to permit stand-up pedalling against resistance. A second exercise unit is attached to an upstanding vertical section of the frame, and is of adjustable height so that the person who is standing and pedalling on the lower exercise unit may adjust the upper unit to the height of his hands or to a height at which certain muscles may be conveniently exercised. To promote the optimum exercise of certain muscles in the lower muscle group a shank of which produces a significant but yielding resistance to the forces of the body weight and muscular activity of a person pedalling in a standup position is provided for the first bidirectional exercise unit. The upper and lower muscle groups may be exercised in synchronization or at will.

5 Claims, 15 Drawing Figures

FIG. 8
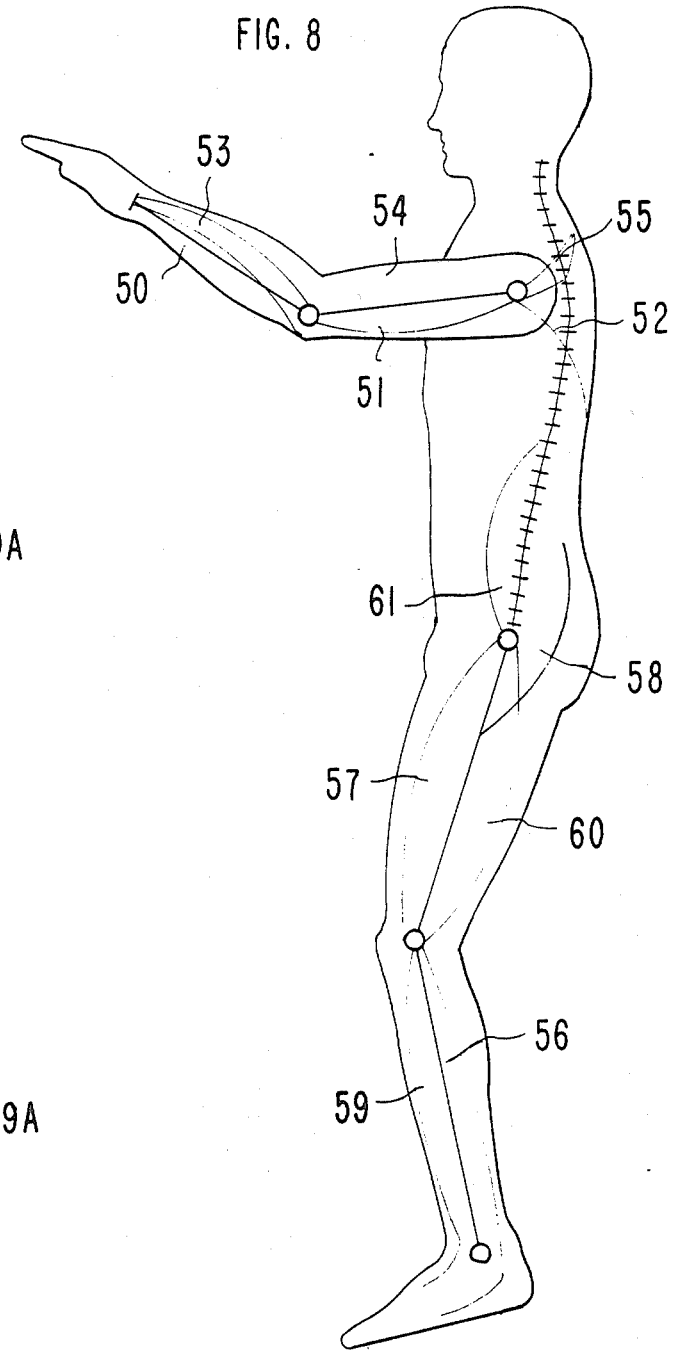
FIG. 9
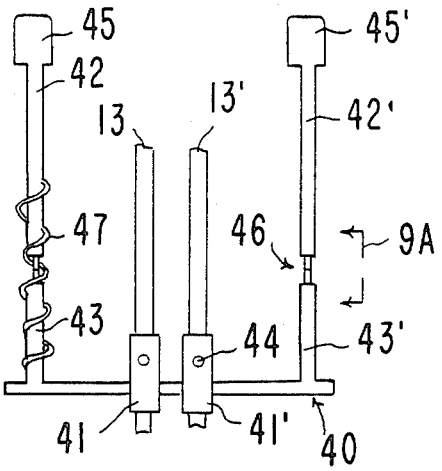
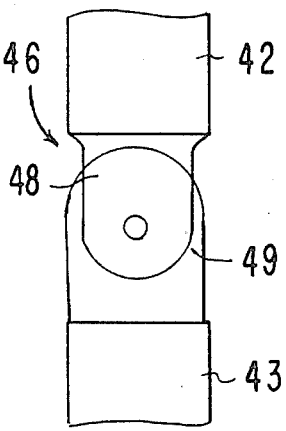
FIG. 9A
FIG. 10
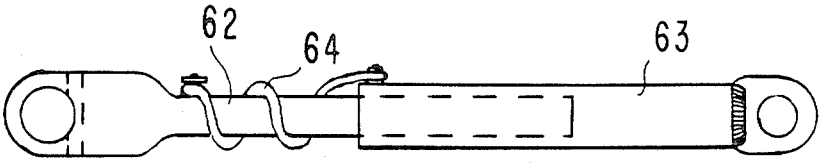

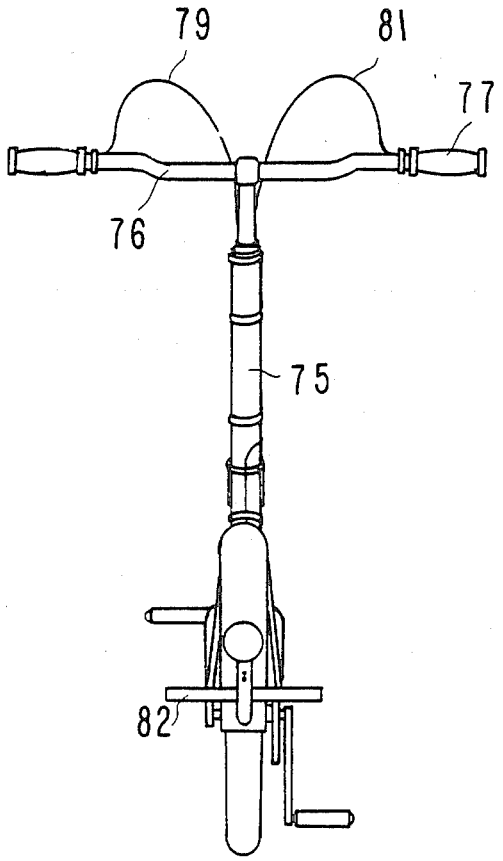
FIG. 11
FIG. 12
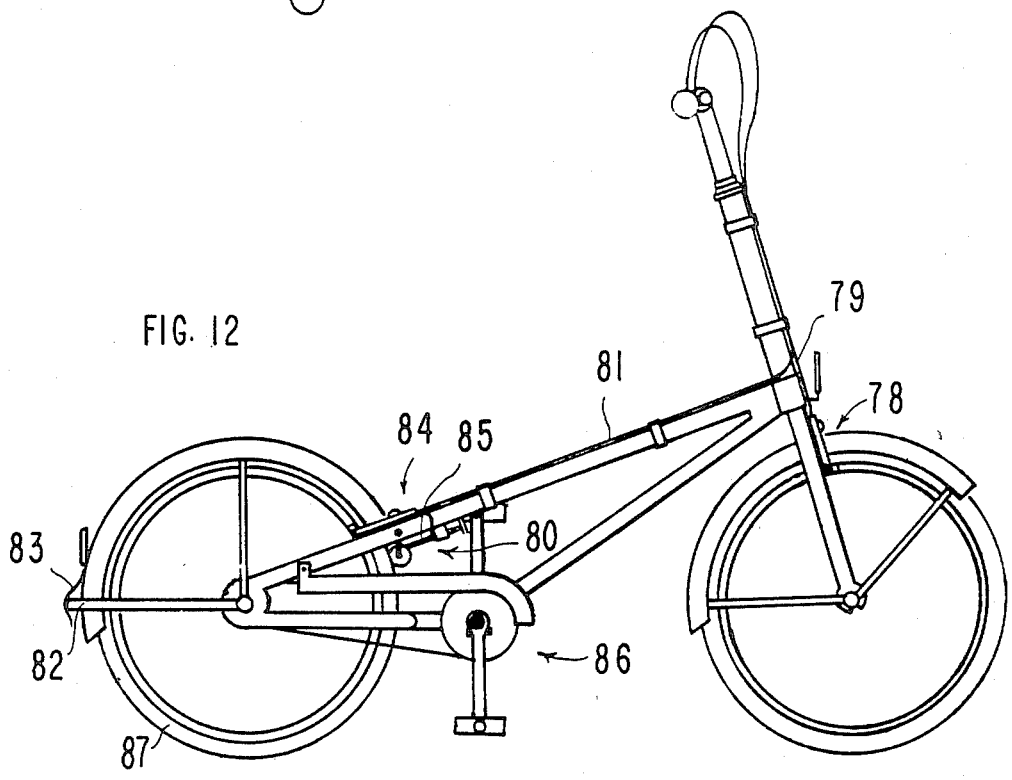

EXERCISE MACHINE HAVING PEDALS WHICH EXTEND RADIALLY AGAINST RESISTIVE MEANS

This is a continuation-in-part of co-pending application Ser. No. 708,233 filed on Mar. 5, 1985, now abandoned.

This invention relates to exercise machines of the bicycle type and, more particularly, relates to a bicycle type exercise machine which is bidirectional and while simulating the exercise of running or jogging allows the exercise of upper and lower muscles in both the forward and the backward categories.

Stationary exercise machines which simulate active exercises have been in use for some time. A typical machine resembles a bicycle having a single wheel. The wheel is suspended in mid-air and is driven to rotate by a chain or belt drive from a sprocket equipped with cranks and foot pedals. A seat and handlebars are provided on a frame to allow the operator to simulate the exercise of riding and pedalling a bicycle. These bicycle type exercise machines are shown, for example, in R. I. Proctor, "Inertial Cycle Exerciser", U.S. Pat. No. 4,007,927; and B. K. Bassler, "Exercising Device", U.S. Pat. No. 3,212,776. The wheel on such bicycle type exercisers is normally fitted with some type of brake mechanism to produce an adjustible amount of drag on the wheel or on the pedals to thereby vary the amount of exercise obtained by the operator. See, for example, "Brake Assemblies Primarily For Exercising Apparatus", U.S. Pat. No. 4,417,724; and D. J. Gibbs, "Exercising Apparatus", U.S. Pat. No. 4,243,217. The cranks are usually formed as a unitary part in a single forging. They are held in a bearing assembly between a shoulder and a threaded portion by a nut. While exercising on this type of apparatus the operator is normally restricted, as on a bicycle, from pedalling backwards since the bearings and the pedals would loosen. Thus, on this type of bicycle the operator cannot fully exercise the lower backward muscles such as the dorsi flexors, the hamstrings or hip flexors as he would be able to do if he could pedal backwards under load while in the standing position. Thus, the prior art bicycle type exercise machines have been both cumbersome and unable to provide the full range of exercises desired by adults and those training for active sports.

A number of bicycle type exercise machines have been proposed which will enable the exerciser to stand up while pedalling in order to simulate walking, jogging or running. In H. G. Sanquist, "Foot Pedal Exercise Machine For Simulating Jogging", U.S. Pat. No. 3,563,541, the exerciser slips his feet into recesses within weighted foot pedal platforms which are mounted on pedal cranks. This machine only permits pedalling in the forward direction. In R. J. DeCloux, "Bimodal Exercise Device", U.S. Pat. No. 4,477,072, clutches and gears are used to weight the pedal specifically for stand-up bicycling. With this device, there is no possibility of exercising with a backwards pedalling motion. The emphasis is on providing angular forces to assist the operator through top dead center and bottom dead center in the pedalling cycle in order to avoid the development of muscles Similarly, in J. A. Malone, "Propelling Gear", U.S. Pat. No. 653,873 and in W. J. Devers, "Crank Motor", U.S. Pat. No. 538,242, the length of the shank is increased on the downward side of the pedalling cycle so as to lengthen the lever arm thereby reducing the effort required to pedal. Thus, with none of the above prior art devices has the operator been allowed to stand in a natural vertical position while fully exercising his lower muscles. And, none of the prior art bicycles have provided exercise that is strenuous enough to simulate running forwards or backwards up a hill or in loose sand. It would be desirable to simulate such heavy exercise in an erect stance and to provide additional benefits without the problem of potential injury to the feet, ankle and hip caused by the impact of the feet on a hard surface that is associated with jogging.

Rotary arm exercise machines have been proposed. These include machines which are to be attached to a frame or to a stationary surface, in both cases at a fixed height. These include, for example, H. A. Morgan, "Rotatable Handle Bar For Exercise Apparatus With Adjustible Rotational Resistance Control", U.S. Pat. No. 3,601,395; and E. Hegel, "Friction Type Exercise Device", U.S. Pat. No. 4,060,241. In G. E. Peters, "Exerciser For Disabled Persons", U.S. Pat. No. 4,402,502, separate rotary exercisers for the arm and leg are included in a single apparatus intended for therapeutic use by a patient. The patient sits in a wheel chair and extends his arms and legs to operate both the hand and leg cranks at the same time. Rotation occurs in one direction only. In R. A. Figueron, "Exercising Device", U.S. Pat. No. 4,423,863, an arm and leg exerciser are combined on a single bicycle-like frame. Both units are operated while the person is seated and hunched over in order to reach the handles of the arm exercise equipment. And, in J. L. Beistegui, "Gymnastic Bicycle", U.S. Pat. No. 4,479,646, a pedal driven cam produces an oscillatory motion in the handlebars. The operator can then force the legs to work against the arms. Neither independent exercise of the upper muscle group nor strenuous exercise of the lower backward muscles is possible.

It is therefore an object of the present invention to provide an exercise machine that will allow the building up of both the lower muscles comprising the foot, leg and hip muscles, and the upper muscles, comprising the wrist, elbow, arm, shoulder and back muscles.

It is another object of the present invention to provide a machine which allows the direction of rotation of the lower exercise unit to be reversed to allow for the development of the lower backward muscles such as the dorsi flexor, hamstring and hip flexor muscles.

It is still another object of the present invention to allow for the rapid buildup of strength in the leg muscles by providing spring loaded shanks for the pedals of a lower exercise device.

It is yet another object of this invention to provide an additional exercise unit for the development of the upper torso which may be reversed in operation to allow for the exercise of the upper backward muscles.

It is still another object of the present invention to provide a machine which will allow development of the rhythm between the upper and lower muscle groups and between the forward and backward muscle groups.

It is still another object of the present invention to provide an exercise machine which provides benefits to people of different physiognomies by providing shanks capable of providing a significant but yielding resistance along the direction of the shank against the forces produced by the body weight and muscles of a person pedalling in a stand-up position. It is a further object of this invention to provide means of adjusting the height of the exercise unit for the upper torso.

It is still another object of the present invention to provide a mobile bicycle built for stand-up exercise of the forward and backward lower muscles.

It is a final object of the present invention to provide a lightweight, protable exercise unit which is sturdy enough for athletes to use on a strenuous exercise schedule.

SUMMARY OF THE INVENTION

An exercise machine is provided for exercising lower and upper muscles in both the forward and backward categories. Complete exercise is provided by the bidirectional nature of the exercise equipment. In one embodiment, a first bidirectional rotational exercise unit is attached to a frame to permit stand-up pedalling against a variable resistance. A second bidirectional exercise unit is attached to an upstanding vertical section of the frame, and is of adjustible height so that the person who is standing and pedalling on the lower exercise unit may adjust the upper unit to the height of his hands or to a height at which certain muscles may be conveniently exercised. To promote the optimum exercise of certain muscles in the lower muscle group a shank is provided for the lower exercise unit which provides a significant but yielding resistance along the direction of the shank to the forces produced by the body weight and muscular action of a person pedalling in a stand-up position. In another embodiment the upper exercise unit permits the operator to push and pull against resistance to simulate the movement of the hands and arms during jogging.

BRIEF DESCRIPTION OF THE DRAWINGS

For a more complete understanding of the exercise machine of the present invention, reference may be had to the accompanying drawings which are incorporated herein by reference and in which:

FIG. 8 is a side view of a human which illustrates the principal forward and backward muscle groups;

FIG. 9 is an end view of an alternate embodiment of the upper exercise unit which permits the forward and backward movement of each hand and arm;

FIG. 9A is an expanded view of the swivel assembly of FIG. 9;

FIG. 10 is a side view of a shank of variable length;

FIG. 11 is a rear view of a portable embodiment of the present invention;

FIG. 12 is a side view of the portable embodiment of FIG. 11;

DESCRIPTION OF THE PREFERRED EMBODIMENTS

Figure 1:
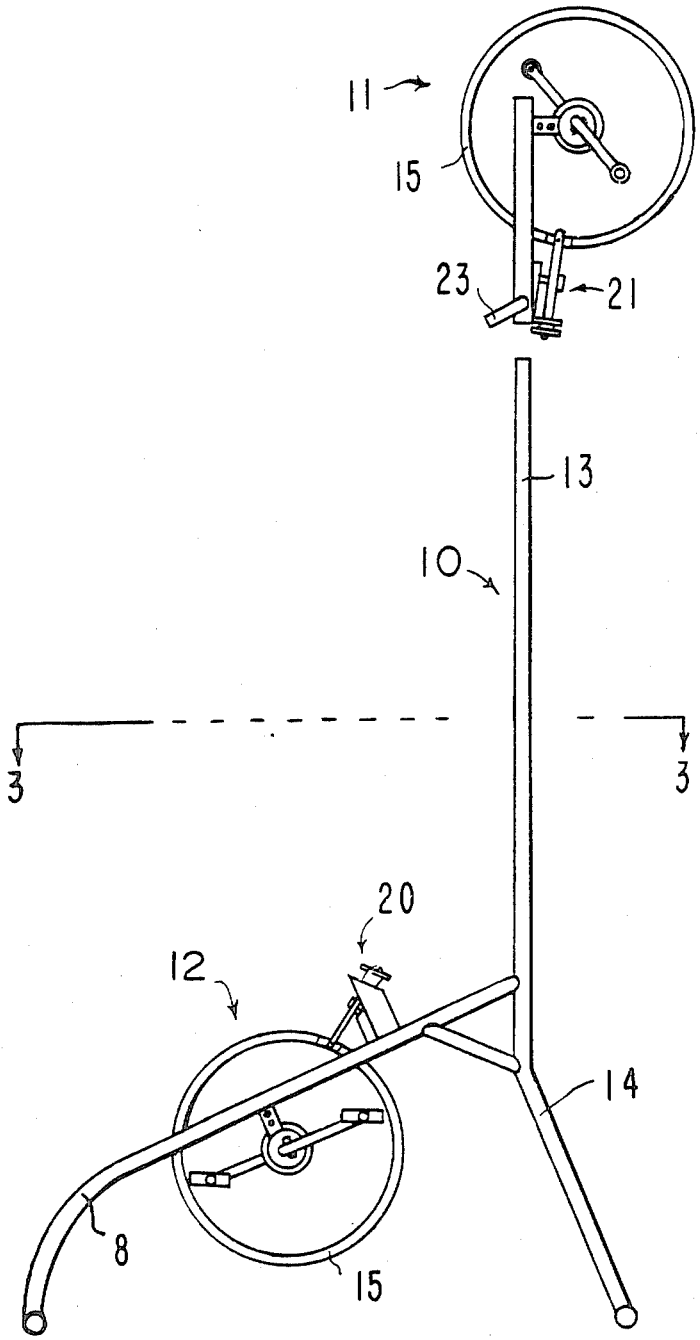
FIG. 1 is a side elevational view of a machine in accordance with the present invention.
Figure 2:
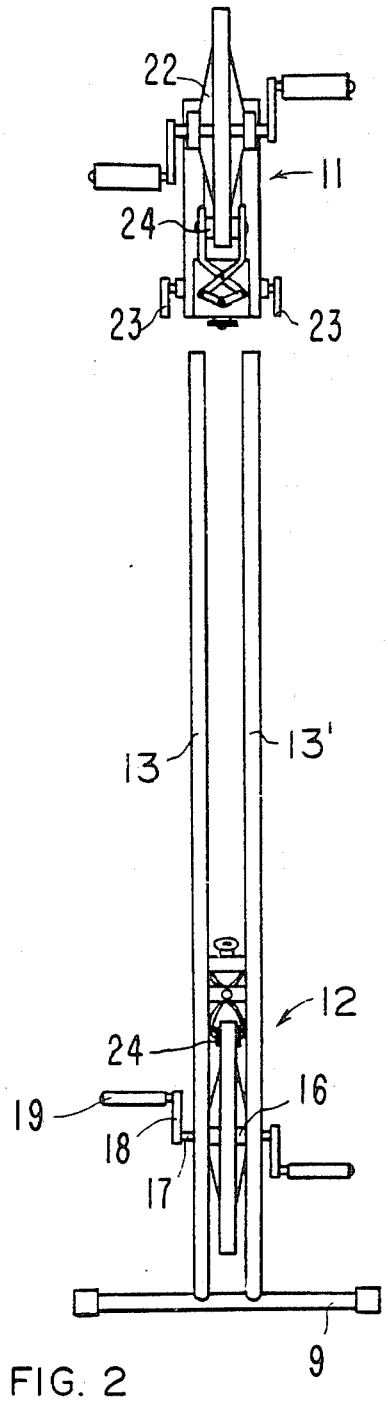
FIG. 2 is a front elevational view of the machine of FIG. 1.
Figure 3:
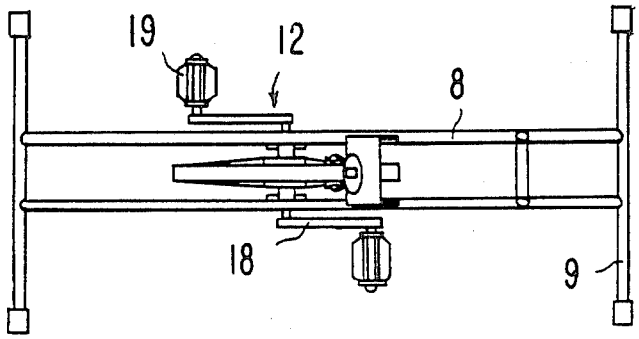
FIG. 3 is a partial plan view of the machine of FIG. 1, taken through lines 3—3 in FIG. 1.

An exercise machine in accordance with the present invention is shown in side vide in FIG. 1 and in end view in FIG. 2. The frame 10 consists of an upstanding vertical section having parallel bars designated 13 and 13', which serve as handles for balancing and as a support for an upper exercise unit, and a lower section 14 which serves as a support for a lower exercise unit 12. The frame is preferrably fabricated from lightweight, hollow metal tubing. In accordance with the principal of the present invention the upper and lower exercise units are bidirectional and allow exercise of the forward as well as the backward muscle groups. In the embodiment of FIGS. 1-3, a unicycle exercise unit 12 is attached to the lower section 14 of the frame 10 for the purpose of exercising the lower muscle group. In this embodiment, a second unicycle exercise unit 11 is attached to the upstanding vertical section 13, 13' for the purpose of exercising the upper muscle group. The benefits of the bidirectional exercise of the upper and lower muscle groups is described subsequently. Each of the unicycle exercise units 12 and 11 comprises a wheel 15 and a rim 22, shown to be solid, which is connected by an axle and a wheel bearing housing 16 to the respective section of the frame 10. At the end of each axle 17 is a shank 18 which supports a pedal 19. Each of the unicycle exercise units 12 and 11 has an adjustable rotational resistance unit, 20 and 21, respectively, which grips the rim 15 by brake pads 24 so as to vary the amount of exercise provided to the operator. Each of the rotational resistance units is attached to the frame in proximity to the wheel 15 so that the wheel 15 or the rim 22 may be positively braked. Due to the vertical orientation of the upstanding section 13 the exercise of upper muscle groups occurs with the operator in a position that would be normal when running or jogging in contrast to the position assumed by the arms during normal bicycle type exercise where the operator is seated or has handle bars in front of him and below the level of his chest.

The principal muscles which are utilized in active sports such as basketball, hockey, etc., are indicated in TABLE 1, the contents of which are taken from W. C. McKinney and G. A. Logan, "Automatic Kinesiology" (W. C. Brown 1982). It can be seen that these muscles are divided into two broad categories: those that are utilized in Forward Movements and those that are utilized in Backward Movements. For each major anatomical feature of the body there is a muscle assigned to accomplish the forward movement and a corresponding muscle assigned to accomplish the rearward movement. Thus, for the elbow the muscle 51 accomplishes the forward movement while the muscle 54 accomplishes the rearward movement. The muscle 51 is denoted an extensor muscle while the muscle 54 is denoted a flexor muscle. Similarly, the plantar flexors 56 move the lower leg forward while the dorsi flexor 59 moves the lower leg backwards. These muscles are also shown in the human figure of FIG. 8. Thus, it can be seen that any exercise machine which only provides for the exercise of the forward muscles, 50, 51, 52, etc., does not provide complete exercise. The backward muscles are particularly important in active sports where the players must be able to move rapidly in all directions. Unfortunately, the backward muscles of the lower muscle group such as the dorsi flexor 59 and the hamstrings 60 are not properly exercised by conventional exercise machines of the bicycle type. With the machine of the present invention the forward and backward muscles 50, 52, 59 and 60 in the vicinity of the knee, are strengthened by the forward and backward exercise provided by the bidirectional pedalling. It is highly desirable for the play of active sports that all the backward muscles be in good condition to avoid series bruises or other injuries and to permit superior performance. It can be appreciated, therefore, that an athlete would want to train on equipment that would exercise the lower backward muscles 59, 60 and 61, as well as the lower forward muscles 56, 57 and 58. For collateral support of the importance of the backward muscles reference may be had to P. J. Rasch and R. K. Burke, "Kinesiology and Applied Anatomy", (Lee & Febiger 1971).

Figure 7:
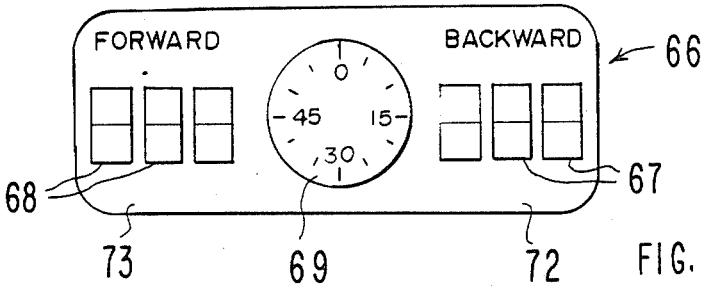
FIG. 7 is a front view of a meter for displaying the total number of forward and backward rotations with the lower exercise unit.
Figure 15:
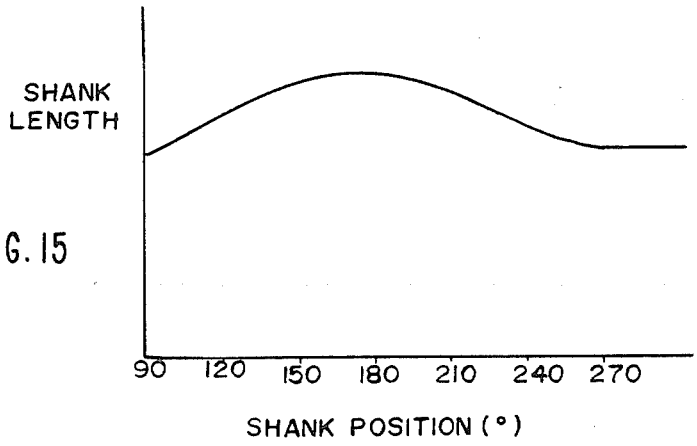
FIG. 15 is a graph of shank position versus shank length or displacement.

The exercise machine of the present invention provides exercise for both the muscles in the forward and in the backward muscle group. This complete exercise is provided by incorporating universal exercising units which are bidirectional. In the embodiment of FIGS. 1–3 a unicycle 12, described structurally in a previous paragraph, has an exercise wheel that may be rotated in both directions. The wheel 15 may have a solid body 22 or may have spokes as with a conventional bicycle wheel. Spokes are preferred because the rim may be more easily maintained in a straight and true condition for even braking. The pedals 19 are equipped with the adjustible straps to ensure the exercise of the foot muscles as well as the comfort of the person exercising. In accordance with the preferred embodiment of the present invention, the shanks 18 vary in length around the pedalling cycle to enhance the exercise provided to the operator. As shown in FIG. 10, the shank has a female section 63 and a male section 62. The spring 64 connects the two sections 63 and 62 such that male section 62 is inserted a variable distance into female section 63, which distance depends upon the force that is applied between the two external ends. As a consequence, the cumulative length of the shank will vary around the cycle as variable forces are exerted by the operator. The spring 64 is of appreciable strength so that the combination of body weight and muscular force causes it to stretch or to yield slightly. The yielding, as seen in the graph of FIG. 15, increases the length of the shank in the portion of the pedalling cycle which occurs below a horizontal line through the axle. As a result, the operator experiences a sensation like running in deep wet sand and the lower muscles, particularly the lower backward muscles, receive significant exercise. In one embodiment of the present invention the operator is apprised of the number of revolutions in either direction by an indicating meter shown in FIG. 7. The total number of revolutions in the forward direction is shown in the digits 68 shown in the forward indicating section 73 and the total number of revolutions in the backward direction is shown in the digits 67 of the backward section 72. The total time which the operator desires to exercise can be set on the mechanical timer 69 which causes a bell to ring at completion of the time period. The revolution meter 66 may be actuated by two spring switches, one of which is triggered by the rotating shank in forward operation and the other by the backward operation; alternately, any means may be used which senses the regular passage of a particular point on the wheel such as a Hall sensor or capacitive means.

Figure 5:
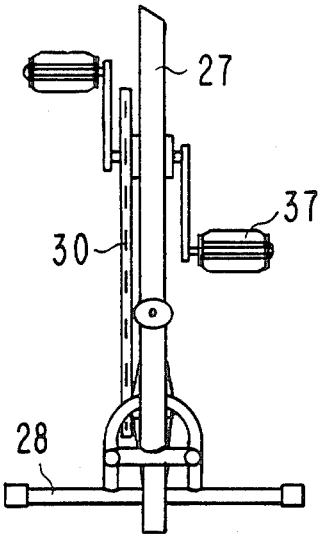
FIG. 5 is a plan view of the embodiment of FIG. 4 as seen from the lines 5—5 of FIG. 4.
Figure 6:
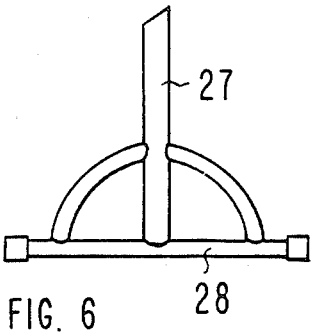
FIG. 6 is a partial end view of the embodiment of FIG. 4 taken through line 6—6.
Figure 4:
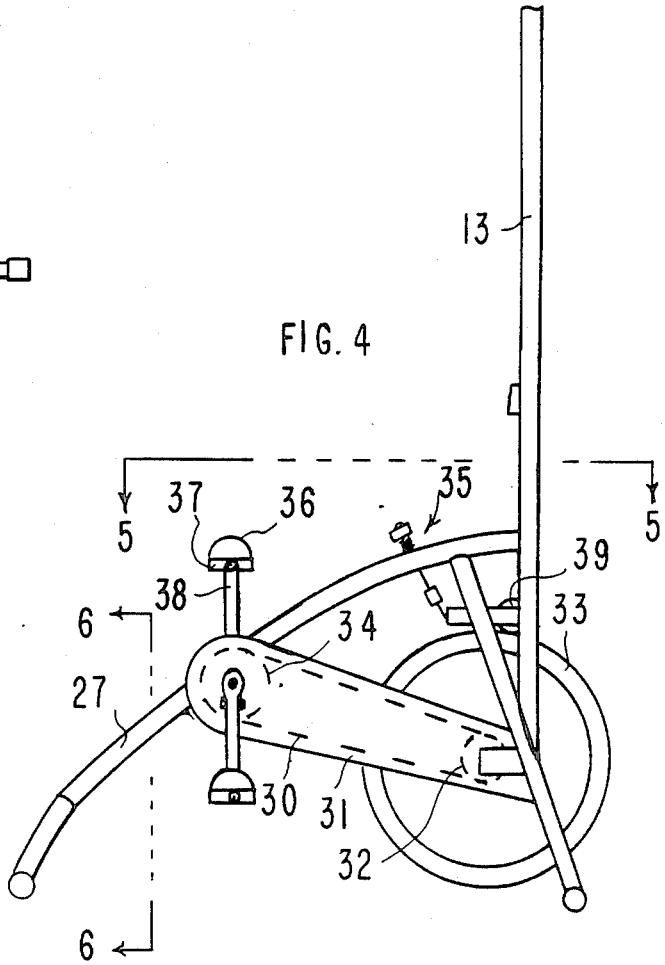
FIG. 4 is a side view of an alternate embodiment of the lower rotational exercise device incorporated in the exercise machine of the present invention.

As long as the bidirectional principal of the present invention is maintained, alternate versions of exercise units for the upper and lower groups of muscles may be provided. A variation of the lower exercise unit is shown in FIGS. 4–5. Here, a conventional sprocket bicycle type drive is provided. The operator slips his feet into the pedal 37 underneath the toe strap 36. As the operator stands up and exercises, in either direction, the sprocket 34 causes the chaim 30 to rotate and turn the wheel 33 via the wheel sprocket 32. The chain guard 30 protects the leg of the operator. The adjustible rotational resistance unit 35 exerts a variable force on wheel 33 by means of roller 39. The crossbar 28 on frame 27, shown particularly in FIG. 6, provides a stable support in the presence of the two rotating sprockets 34, 32 and the cycling chain 30. A variation of the upper exercise unit is shown in FIGS. 9 and 9A. A push-pull type exercise is provided by the level arms 42. The sleeves 41 and 41' are slid over the upstanding vertical frame bars 13 and 13' and tightened by means of set screws 44 and 44'. In use, the operator grips the hand grip 45 with his left hand and grips the hand grip 45' with his right hand. The lever arm will move forward and backward about the swivel assembly 46, shown particularly in FIG. 9A. Resistance is provided by the spring 47 which is coiled around stud 43 and the bottom of lever arm 42. A similar spring (not shown) is coiled around stud 43' and the bottom of lever arm 42'. The studs 43, 43' are firmly attached to crossbar 40 which is attached to sleeves 41, 41'. The pushing and pulling of the lever arms 42, 42', occurs about the swivel joint provided by the union of the tongue 48 at the bottom of lever arm 42 and the tongue 49 at the top of stud 43. The motion may be in synchronization with the motion of the feet in the lower exercise unit or may follow any pattern chosen by the operator. The strength of the spring may be varied to control the extent of exercise provided to the upper muscle group.

The prior art shows the placement of a bicycle on a rack which permits the wheels to be pedalled against a variable resistance. See, for example, G. J. Jordaan, "Exercising Apparatus", U.S. Pat. No. 4,322,070. Such apparatus do not allow bidirectionality due to the aforementioned limitation of bicycle linkages and do not allow the full exercise of the lower muscle groups in the forward direction because of the low placement of the handlebars and the presence of a seat. The principle of the present invention is incorporated in the 'Jogger Bicycle' of FIGS. 11 and 12. Here, the adjustible rotational resistance assembly 80 applies a drag to the rear wheel 87 as threaded rod 85 is adjusted. Rear wheel 87 and the companion front wheel are small so that the bicycle will not cover great distances but will require strenuous effort. Optionally, the bicycle may be pedalled forward or backward in place as the kickstand 82 is lowered out of the holding position produced by spring clip 83. The rear brake 84 is controlled by right grip 77 via cable 81; the front brake 78 is controlled by the left grip via cable 79. The brakes are not intended to provide the resistance to pedalling, just the control of the bicycle when it is operated as a moving vehicle. The drive 86 is a conventional direct connected bicycle type without coaster brake. The advantages of the 'Jogger Bicycle' are that it must be used in the stand-up position while pumping forward against a frictional load in addition to whatever moving load is present and the backward muscles may be exercised in slowing and stopping the bicycle. When the 'Jogger Bicycle' is parked and operated with the kickstand down, the forward and backward muscles may be exercised against a frictional load as in the fully stationary machines shown in FIG. 1 and FIG. 4. Furthermore, the operator may obtain serious exercise either indoors or outside without damaging bones, tendons or other anatomical portions of the body.

Figure 13:
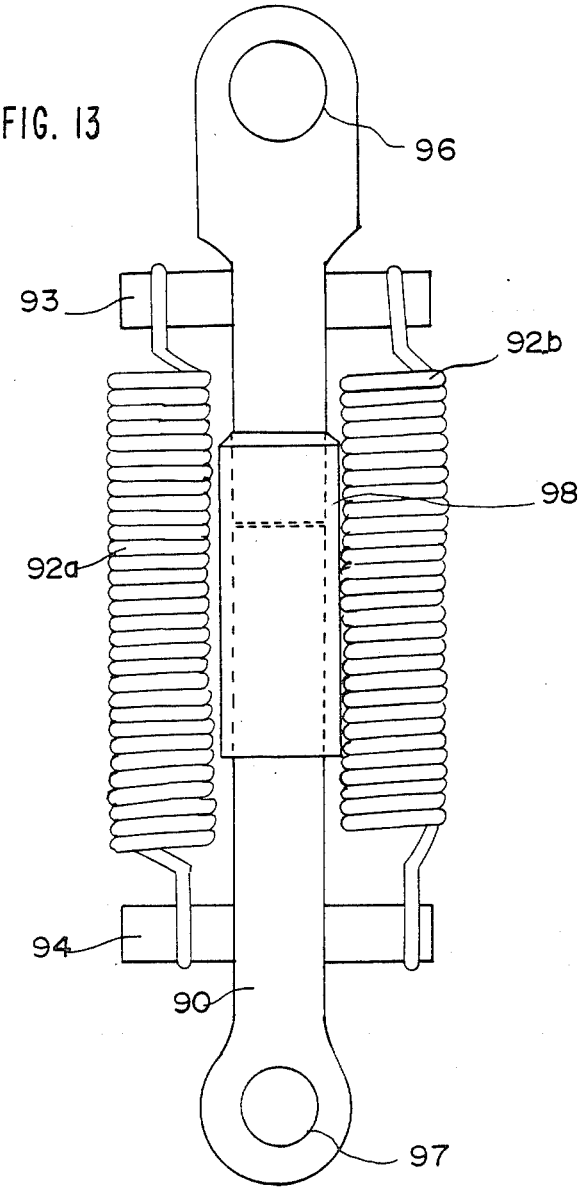
FIG. 13 is a front view of a shank which supplies a significant but yielding resistance for use with the present invention.
Figure 14:
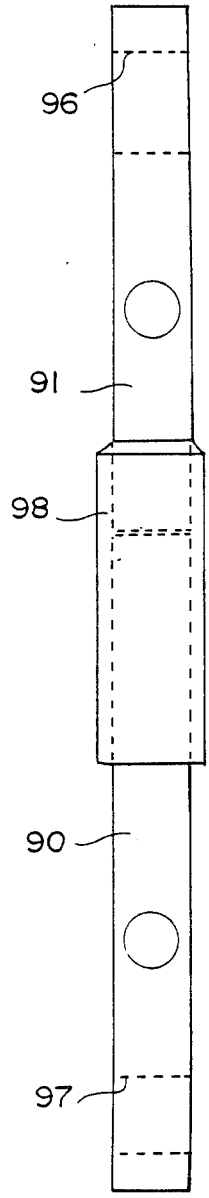
FIG. 14 is a side view of FIG. 13.

The preferred embodiment of the present invention, as discussed above with respect to FIG. 10, may be further understood by reference to FIGS. 13–15 in light of the kinesiology of exercise of the lower muscle groups. In the ensuing discussion the uniqueness of the invention in fully exercising the forward and backward muscles of the lower group becomes clear. In a conventional bicycle-type exercise machine the operator pedals with both feet in a synchronized sequence. Pressure is progressively applied to each pedal as it moves from the highest pedal position (the 'straight up' position, defined here as 0°) down through the lowest pedal position (the 'straight down' position, defined here as 180°). The applied pressure comes from a combination of muscular force and the weight of the person, the latter being significant if the person is exercising in a stand-up position. The effect of the applied pressure is to rotate the shank and axle and to extend the leg, thereby exercising particularly the forward muscles of the lower group. In a conventional bicycle-type exercise unit the extension of the leg is limited to the distance between the knee of the operator and the foot. Even if the operator stands the handlebars are positioned low and the legs are never extended to their fullest extent. The applied pressure is resisted by the pedal which is held in a fixed position; the axle alone is caused to rotate. The operator has the sensation of jogging or walking on firm ground. In certain prior art bicycles of the modified type previously described, e.g. in W. J. Devers, U.S. Pat. No. 538,242, and in J. A. Malone, U.S. Pat. No. 653,873, the pedal is free to move within a track to thereby increase the length of the shank on the downward portion of the cycle. The increase in length of the shank provides a greater lever arm and makes it easier to pedal, i.e. allows a given torque to be applied to the axle with a lesser force being applied to the pedal. Thus, either with conventional bicycle-type exercisers or with modified type bicycles the operator is not provided with exercise of the lower muscle group which is more strenuous than normal walking or jogging. And the backward muscles of the lower muscle group are not much exercised.

With the exercise machine of the present invention, as discussed with reference to FIG. 10, the operator encounters a significant but yielding resistance to the pressure applied by the foot between 90° and 270° in the pedalling cycle. For the shank of FIG. 10 and the shanks of FIGS. 13–14 the length of the shank begins to increase when the threshold strength of the stiff springs 64 and 92*a*, 92*b*, respectively, are exceeded by the net force (muscular action plus body weight) of the operator. When the threshold strength (greater than or equal to 200 lbs/inch) is exceeded the operator will have the sensation of stepping into heavy mud or deep wet sand. The actual displacement of the shank will be as shown in FIG. 15: the length of the shank begins to increase at 90°, i.e. at the intersection of the pedal and a horizontal line through the axle, on the downward stroke of the pedalling cycle and increases gradually until the full body weight and forces of the lower muscle group are applied at 180°, after which the length decreases abruptly until the shank resumes its unstretched position at 270°. Since the exercise unit is bidirectional the forward or backward muscle groups can both be exercised. Since the foot of the operator follows the pedal as the shank expands in length, the muscles of the lower group, both forward and backward, cycle through a greater portion of their potential range, as pedalling is done either in the forward or backward direction, respectively. And the body of the operator experiences more extensive movement as the upper torso (as well as the center of gravity) oscillate through greater vertical displacements.

The exercise routine described in the previous paragraph is greatly aided in the present invention by the upstanding vertical section of the frame, as described previously. Whether or not an upper exercise assembly is provided, the upstanding vertical section, such as upright members 13 and 13' in FIG. 2, may be held by the operator as he stands and exercises on the lower exercise assembly. Preferrably, the upright members 13 and 13' are high enough to allow the operator to hold on at or above chest height since it has been found that the benefits of exercise to the muscles of the lower group are increased when the muscles are stretched out in this manner. The greatest amount of exercise is still accomplished by the forward and backward muscles of the lower group but their exercise through an extended range is facilitated when the operator can hold onto the upstanding vertical section and stabilize himself with his arms held at or above chest level.

The structure of the shank of FIGS. 13 and 14 is symmetrical about the axis of the shank. Shank stem 90 is attached to the pedal (not shown) through opening 97; shank stem 91 is attached to the axle (not shown) through opening 96. Shank stems 90 and 91 are connected by sleeve 98 which is fixedly attached at the end of shank stem 90. Shank stem 91 slides over the sleeve 98. The springs 92*a* and 92*b* are attached between crossbar 94 on shank stem 90 and crossbar 93 on shank stem 91. When no appreciable force is applied to the pedal the ends of shank stems 90 and 91 will be butted together within sleeve 98. If, for example, the strength of the springs 92*a*, 92*b* are 100 lbs/inch each then the operator must apply a net force of 200 lbs/inch to cause the springs to yield and the length of the shank to be increased. The operator engages in significant work in the process of extending the length of the shank between 90° and 180°, and still engages in work while the shank is collapsing to its steady state position, between 180° and 270°. More importantly, the muscles of the lower muscle group are exercised through an extended range, i.e., they are stretched out while they are undergoing the exercise, thereby providing greater conditioning. Thus, for example, the muscles of the lower group of the backward type such as the dorsi flexors, the hamstrings and the hip flexors are provided extended exercise—a phenomenon that never occurs with conventional exercise bicycles or modified bicycles of the type described previously.

TABLE 1

| | FORWARD MOVEMENT | | BACKWARD MOVEMENT | |
|---|---|---|---|---|
| | (Extensor Muscles) | | (Flexor Muscles) | |
| UPPER MUSCLE GROUP | Wrist | 50 | Wrist | 53 |
| | Elbow | 51 | Elbow | 54 |
| | Arm | 52 | Arm | 55 |
| LOWER MUSCLE | Plantar flexors | 56 | Dorsi flexor | 59 |
| | Quadriceps | 57 | Hamstrings | 60 |

TABLE 1-continued

| | FORWARD MOVEMENT | | BACKWARD MOVEMENT | |
|---|---|---|---|---|
| GROUP | Gluteus maximus | 58 | Hip flexors | 61 |

We claim:

1. An exercise machine for providing extended exercise for the forward and backward muscles of the lower muscle group, comprising:

a frame for supporting at least one bidirectional rotational exercise assembly for exercising the forward and backward muscles of the lower group in a standing position; and a bidirectional exercise assembly mounted on said frame, said assembly including a central axle having portions extending on either side of said frame, a shank attached to each of said portions of said axle, each of said shanks having a foot pedal attached thereto opposite the end attached to said axle, each of said shanks comprising a first member which is slidably inset within a second member and wherein said first member and said second member are connected by a spring having a bias strength greater than 200 lbs/inch which holds said first member in a fully seated position within said second member whereby said first member slides outwardly from within said second member when the operator of said exercise machine applies a force to said pedal which exceeds the strength of said spring, said means being extended in the segment of the pedalling cycle from 90° to 270°, whereby the operator in a standing position may exercise said forward and backward muscles of the lower muscle group through an extended range.

2. An exercise machine in accordance with claim 1 wherein said spring comprises a pair of individual springs, each of said individual springs in said pair of individual springs being attached between said first member and said second member along opposing edges of said shank.

3. An exercise machine in accordance with claim 1 wherein said bidirectional rotational exercise assembly further includes:

a sprocket attached to said axle;

a wheel which is rotatably attached to said frame;

a chain which rides around said sprocket and drives said wheel; and a variable resistance means attached to said frame adjacent said wheel and in contact with said wheel whereby the force required to drive said wheel may be varied by adjustment of said variable resistance means.

4. An exercise machine in accordance with claim 1 wherein said axle supports a wheel and wherein said bidirectional rotational exercise assembly further includes a variable resistance means attached to said frame adjacent said wheel in contact with said wheel whereby the force required to rotate said wheel may be varied by adjustment of said variable resistance means.

5. An exercise machine in accordance with claim 1 wherein said frame further includes an upstanding vertical section for providing the person exercising with a place to hold on and stabilize himself as he exercises, the height of said upstanding vertical section being great enough to permit the person to hold on at or above chest height while exercising in said standing position.

20. An exercise machine in accordance with claim 19 in combination with an additional exercise assembly attached to said upstanding vertical section whereby said person may exercise his upper torso by exercising his arms at or above chest height.

* * * * *